US006943732B2

(12) United States Patent
Göttl et al.

(10) Patent No.: US 6,943,732 B2
(45) Date of Patent: Sep. 13, 2005

(54) TWO-DIMENSIONAL ANTENNA ARRAY

(75) Inventors: Max Göttl, Frasdorf (DE); Jurgen Rumold, Bad Endorf (DE)

(73) Assignee: Kathrein-Werke KG, Rosenheim (DE)

( * ) Notice: Subject to any disclaimer, the term of this patent is extended or adjusted under 35 U.S.C. 154(b) by 93 days.

(21) Appl. No.: 10/408,780

(22) Filed: Apr. 8, 2003

(65) Prior Publication Data

US 2004/0108956 A1 Jun. 10, 2004

(30) Foreign Application Priority Data

Dec. 5, 2002 (DE) ..... 102 56 960

(51) Int. Cl.[7] ..... H01Q 1/38
(52) U.S. Cl. ..... 343/700 MS; 343/893
(58) Field of Search ..... 343/700 MS, 853, 343/893, 810, 754

(56) References Cited

U.S. PATENT DOCUMENTS

| | | | | |
|---|---|---|---|---|
| 4,131,896 | A | 12/1978 | Miller | 343/815 |
| 4,937,585 | A * | 6/1990 | Shoemaker | 343/700 MS |
| 6,211,841 | B1 | 4/2001 | Smith et al. | 343/813 |
| 6,313,809 | B1 | 11/2001 | Gabriel et al. | 343/797 |
| 6,351,243 | B1 | 2/2002 | Derneryd et al. | 343/754 |
| 6,646,611 | B2 | 11/2003 | Plet et al. | 343/702 |
| 2002/0021246 | A1 | 2/2002 | Martek et al. | |
| 2002/0171601 | A1 * | 11/2002 | Puente Baliarda | 343/893 |
| 2004/0145526 | A1 * | 7/2004 | Puente Baliarda et al. | 343/700 MS |

FOREIGN PATENT DOCUMENTS

| | | |
|---|---|---|
| DE | 100 12 809 A1 | 9/2001 |
| EP | 0 888 649 B1 | 3/1997 |
| EP | 1 227 545 A1 | 7/2002 |
| WO | WO 00/39894 | 12/1999 |
| WO | 01/13459 | 2/2001 |
| WO | WO 02/05383 A1 | 1/2002 |
| WO | WO 02/084790 | 10/2002 |

OTHER PUBLICATIONS

Karl Rothammel, "Gleichphasig erregte Dipolkombinationen (Querstrahler)," *Antennenbuch*, Chapter 13, pp. 202–204, Stuttgart, Germany (1981).

* cited by examiner

*Primary Examiner*—Tan Ho
(74) *Attorney, Agent, or Firm*—Nixon & Vanderhye P.C.

(57) ABSTRACT

An improved antenna array has at least two columns running vertically. At least in one column and preferably in all columns, at least two radiators or radiator groups are arranged together in a vertical direction. For at least one column having at least two radiators or radiator groups vertically offset from one another, at least one additional radiator group is provided, which is fed commonly with the radiators or radiator groups provided in this column. The additionally provided at least one radiator or radiator group for the column is arranged horizontally offset to the other radiators or radiator groups provided in the column.

22 Claims, 12 Drawing Sheets

TWO-DIMENSIONAL ANTENNA ARRAY

CROSS-REFERENCES TO RELATED APPLICATIONS

Not applicable

STATEMENT REGARDING FEDERALLY SPONSORED RESEARCH OR DEVELOPMENT

Not applicable.

FIELD

The technology herein relates to two-dimensional antenna arrays.

BACKGROUND AND SUMMARY

A generic antenna array usually comprises several radiators or radiator groups, but at least an arrangement of two stacked and two side-by-side radiators or radiator groups, so that a two-dimensional array layout results. For example, such a two-dimensional antenna array may exhibit four columns running vertically, arranged horizontally next to one another, each containing, for example, six to ten radiators or radiator groups arranged the vertical direction, offset one above the other. Depending on the purpose for which they are used, such antennas are sometimes also referred to as "smart antennas", whose uses also include, for example, the tracking of targets (radar) in the military sphere. "Phased array" antennas are also frequently mentioned in these applications. Recently, however, these antennas are increasingly also being used in mobile telephony, particularly in the frequency ranges 800 MHz to 1000 MHz and 1700 MHz to 2200 MHz.

Through the development of new primary radiator systems, it has now also become possible to construct dual-polarized antenna arrays, in particular with a polarization alignment of +45° or −45° with respect to the horizontal or vertical.

Such antenna arrays, regardless of whether they are basically dual-polarized or merely consist of singly polarized radiators, can be used to determine the direction of the incoming signal. At the same time, however, by suitable adjustment of the phase angle of the transmission signals fed into the individual columns, it is also possible to alter the beam direction, i.e. a selective beam shaping is achieved.

This alignment of the beam direction of the antenna array in a different horizontal direction can be achieved by means of electronic beam tilting, i.e. the phase angles of the individual signals can be adjusted by suitable signal-processing means. Suitably dimensioned passive beam shaping networks are equally possible. The use of active or control-signal-driven phase shifters in these feeder networks for altering the beam direction is also known in the art. Such a beam shaping network may, for example, consist of what is known as a Butler matrix, which, for instance, has four inputs and four outputs. According to the input connected, the network generates a different, but fixed phase relationship between the radiators in the individual dipole arrays. Such an antenna construction using a Butler matrix is known in the art from U.S. Pat. No. 6,351,243 for example.

Electronic tilting of the horizontal field pattern can also be undertaken through the use of fixed-setting phases or by using phase shifters between the columns. The use of fixed-setting phases or phase shifters also allows the vertical radiated field pattern to be raised or lowered (down-tilting).

The antenna array can of course also be used such that the individual radiators or radiator groups in the individual columns are operated independently of one another, in order to be used independently of each other in a desired transmit or receive mode.

With regard to the individual radiators or radiator groups arranged in a column, such antenna arrays exhibit a radiated field pattern, whose lobe width running in the horizontal direction lies between roughly 80° and 100°.

Application areas are known, however, where a lobe width of the order of 60° to 65°, for example, is absolutely desirable.

Attempts have already been made to arrange the radiators or radiator groups in the individual columns in different horizontal positions. To a certain extent, this can affect the lobe width of the individual radiators or radiator groups of a column. Lobe widths of between 75° and 100° can be achieved by this means. A further reduction in the lobe width in this way, however, is generally not possible.

The exemplary illustrative non-limiting technology described herein creates an antenna array that, at least in one column and preferably in several or all columns, provides the means for lowering the horizontal lobe width of the radiators or radiator groups in the individual columns to values below 75°.

According to exemplary illustrative non-limiting implementations herein, it is possible, without the entire antenna structure becoming larger, to reduce the lobe width of the column radiators in that, in relation to the radiators or radiator groups arranged vertically one above the other in a column, at least an additional radiator or at least an additional radiator group is provided horizontally offset to this, which preferably is accommodated in an adjacent column. This at least one additional radiator, or this at least one additional radiator group, is not fed, however, with the radiators or radiator groups in the particular column in which they are arranged, but commonly with the radiators or radiator groups of the adjacent column. This allows the lobe width to be reduced significantly, whereby the optimum desired lobe width can be selected preferentially, in that the number of radiators or radiator groups assigned to a certain column but arranged offset to it is chosen in an appropriate way. In practice it has been shown, for example, that the use of two additional radiators or radiator groups in an antenna array that has six to twelve radiators or radiator groups arranged one above the other, is sufficient to achieve a lobe width of around 60° to 65°.

The solution according to exemplary illustrative non-limiting implementations herein can be applied if the radiators used in the individual columns consist of linearly polarized radiators, or dual polarized or circularly polarized radiators. All suitable radiators can be considered, for example dipole radiators in the form of conventional dipole radiators (particularly in the case of linearly polarized antennas) or, as another example, a dipole arrangement shaped in the manner of a dipole quad but radiating in the manner of a crossed dipole, as is basically known in the art from patents such as WO 00/39894. Equally, however, dipole quads or patch radiators etc. can also be used. With X-shaped radiator arrangements in particular, they can be aligned preferably in a +/−45° orientation in the horizontals or verticals.

The column spacing, i.e. the distance between the radiators or radiator groups between two adjacent columns is preferably about A/2 of the mean operating wavelength. However, this column spacing can, in principle, lie in a range from 0.25 A to 1.0 A of the operating wavelength, with the mean operating wavelength preferred. Preferred vertical spacing of the radiators in a column is 0.7 A to 1.2 A. Should an additional radiator or radiator group (which is fed commonly with the radiators in an adjacent column) be integrated in between, then the free clearance to a radiator or radiator group above or below reduces preferably to half the spacing.

As explained, the antenna according to exemplary illustrative non-limiting implementations can be operated such that the basic provision of radiators or radiator groups in a column can be fed and operated independently of those in an adjacent column (of course with the exception of the integrated additional radiators or radiator groups according to exemplary illustrative non-limiting implementations, which are fed commonly with those in an adjacent column). The originally provided radiators or radiator groups in a column are preferably drivable via phase shifters, via which a varying angle of declination with respect to a horizontal plane, or the down-tilt angle as it is known, can be selected.

As within the state of the art, with such an antenna array it is also possible to use integrated or retrofittable control devices, especially electromechanical ones, to perform a remotely controllable phase change with respect to the radiators or radiator groups assigned to the individual columns, such that a desired down-tilt setting can be made in each individual column.

With an antenna array of the kind described herein it is also possible to perform beam shaping of any desired type, particularly in the case where what is known as a Butler matrix or similar beam-shaping network is connected in series with the individual columns and the radiators or radiator groups provided there. As an alternative to this, hybrids can also be connected in the individual columns.

The columns are preferably uniformly spaced from one another, although antenna arrays with non-uniform spacing can be implemented.

The individual radiators or radiator groups in the individual columns can each be arranged at the same height or, alternatively, can each be vertically offset from one another. The middle position of a radiator or a radiator group in a column can be arranged at any relative vertical level to the respective position of the radiators or radiator groups provided there. The vertical offset can also correspond to exactly half the vertical spacing of two radiators or radiator groups arranged one above the other.

If the radiators or radiator groups are vertically offset from one another in two adjacent columns, this offers the advantage that the additionally provided radiators or radiator groups, which are assigned to a certain column but are placed in an adjacent column, can be arranged such that they come to lie at an equal height line next to a radiator or radiator group in the column they belong to. By this means, an optimized antenna can ultimately be implemented without its size increasing.

The additionally provided radiators or radiator groups for reducing the lobe width can be placed preferably centrally as well as at the upper and/or lower end of a column. They can also be placed in any position in between. Fine optimization can be carried out using these positioning measures.

In order to achieve the desired minimization of the lobe width, in exemplary illustrative non-limiting implementations herein, always at least one additional radiator or one additional radiator group is provided for a column, which for this purpose are integrated into an adjacent column horizontally or offset with horizontal or vertical components. The maximum number of these additional radiators or radiator groups equals N−1, where N corresponds to the number of originally provided radiators or radiator groups in a column.

BRIEF DESCRIPTION OF THE DRAWINGS

These and other features and advantages will be better and more completely understood by referring to the following detailed description of exemplary non-limiting illustrative implementations in conjunction with the drawings, of which.

DETAILED DESCRIPTION

Figure 1:
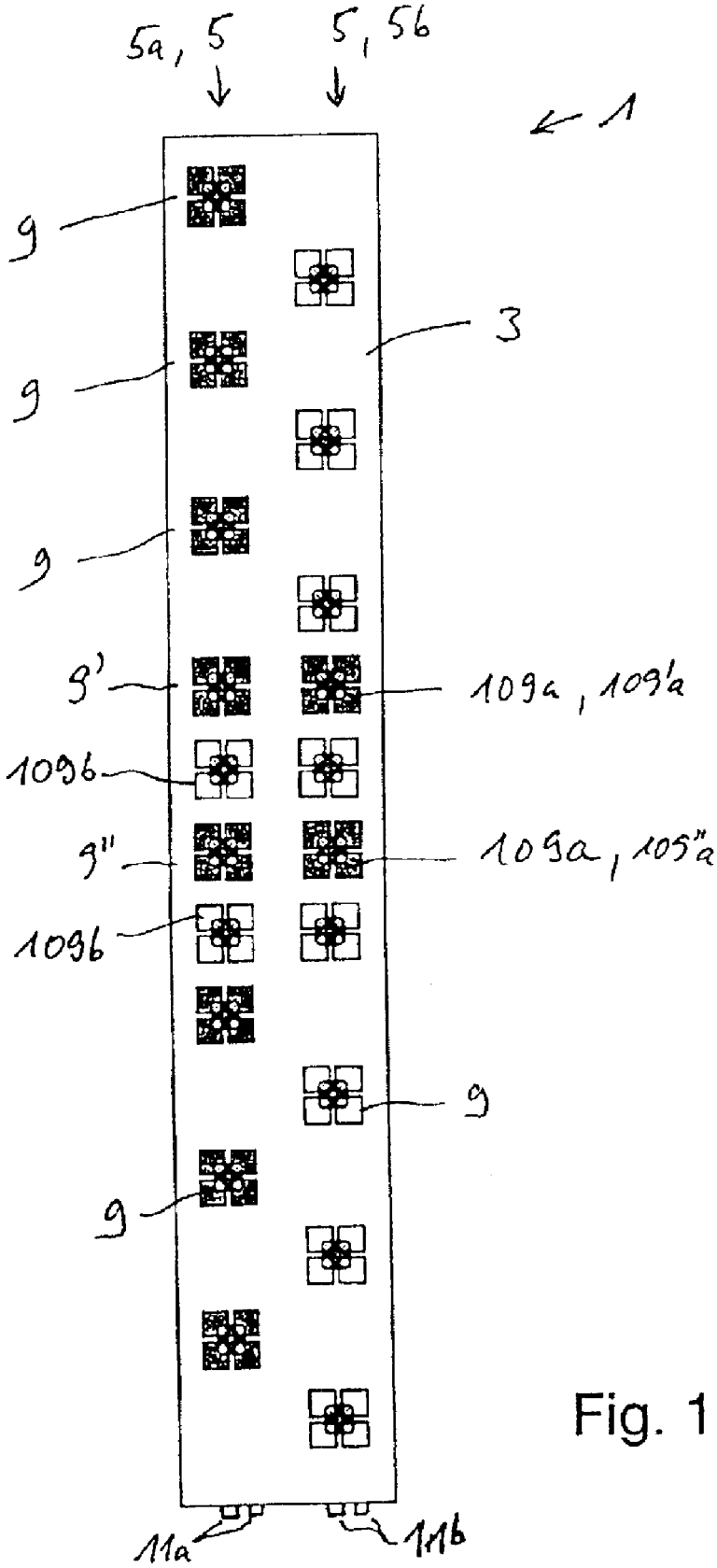
FIG. 1 shows a schematic front view of a two-column antenna array according to an exemplary illustrative non-limiting implementation.

FIG. 1 shows a schematic plan view of an antenna array, 1, according to an exemplary illustrative non-limiting implementation, which normally has a backward reflector, 3, which runs vertically in the case of vertical orientation of the antenna array. The reflector, 3, may, for example, consist of a plate that is electrically conducting or has an electrically conducting surface, whereby its vertical outer limits can have ridges that are angled or even run perpendicular to the reflector plane and extend a certain height above it.

In the illustrative non-limiting implementation shown, the antenna array, 1, contains two columns, 5*a*, 5*b*. In each of the columns 5*a*, 5*b* there are a plurality, i.e. at least two primary or initial i.e. basically provided radiators or radiator groups, 9, vertically offset from one another, the left column, 5*a*, for example, being fed via two inputs, 11*a*, i.e. via one input for each polarization.

In the case of a singly, e.g. vertically polarized antenna only one input, 11*a*, would be provided. That is, all eight radiators or radiator groups, 9, arranged one above the other at regular vertical intervals and shown darkened in FIG. 1 are fed via one input, 11*a*, with the same phase angle. If, instead of a dual-polarized antenna array arrangement, an antenna array having just a single polarization, e.g. vertical, were to be used, then the singly polarized radiators or radiator groups arranged one above the other would be fed via just a single input, 11. Where it is desired that the antenna array is also to be adjustable from an electrical aspect with variable down-tilt angle (i.e. in varying radiation angles with respect to the horizontal plane), diverse phase shifters can be integrated into the antenna array, by means of which the individual radiators or groups of radiators arranged vertically one above the other can be fed with varying phase angle. Thus for each polarization there are again two inputs, 11*a*, provided for one column, whereby the phase angle for the radiators or radiator groups arranged vertically one above the other can be variably adjusted via the feeder network (not shown in greater detail) using several phase shifters, for example. With regard to this, your attention is drawn, for example, to the prior disclosure WO 01/13459 and the contents of this application.

The eight radiators or radiator groups, 9, provided and arranged at regular vertical intervals one above the other in the right column, 5*b*, are likewise fed via two secondary inputs, 11*b*, with the same phase angle, or, where a feeder network having one or more phase shifters is used, with different phase angle to generate a down-tilt angle.

In the exemplary illustrative non-limiting implementation shown, the radiators or radiator groups, 9, consist of what are known as cross-vector dipoles, which in their beam direction are oriented +45° or −45° with respect to the horizontal or vertical. The construction and mode of operation of these polarized radiators, which while appearing more rectangular in shape in the schematic diagram of FIG. 1, in their electrical effect act like cross dipoles in two planes perpendicular to one another, are basically known in the art from patent WO 00/39894, full reference being made to the disclosed contents and to the contents of this application. Instead of these cross-vector dipoles as they are known, conventional cross dipoles or dipole quads or patch radiators etc. can also be used if the individual radiators or radiator groups are each to radiate in two polarization planes perpendicular to one another. This is discussed later on with reference to further schematic figures.

Since, in the most favorable case, the radiators in each of the two columns 5*a* and 5*b* basically exhibit a lobe width not less than 75°, according to an exemplary illustrative non-limiting implementation the provision of additional radiators or radiator groups is now allowed for.

To gain a better understanding, reference is therefore now made to FIG. 2 as well, in which the same antenna array as that in FIG. 1 is depicted but showing only those radiators and radiator groups, 9, provided in the left column, 5*a*, in the antenna array in FIG. 1 (as previously explained with reference to FIG. 1). In other words, the light-colored radiators or radiator groups, 9, shown in FIG. 1 that belong to the second column have been omitted in the example of FIG. 2. To reduce the lobe width of the radiators in the first column, 5*a*, two additional radiators or radiator groups, 109, 109*a*, are now provided in this exemplary illustrative non-limiting implementation which are arranged offset to the first column, 5*a*, preferably in the exemplary implementation in the second column, 5*b*. These are fed commonly with the originally provided radiators or radiator groups, 9, in the first column. By means of these additional horizontally offset radiators and radiator groups, 109*a*, it is now possible to reduce the lobe width. In doing so, the size of the lobe width with respect to the two middle radiators or radiator groups, 9', for example, is concentrated into an angle as narrow as 45°. In the far field, however, only one lobe width is detected, whereby the entire lobe width reduction to e.g. a desired range of about 60° or 65° results.

Figure 3:
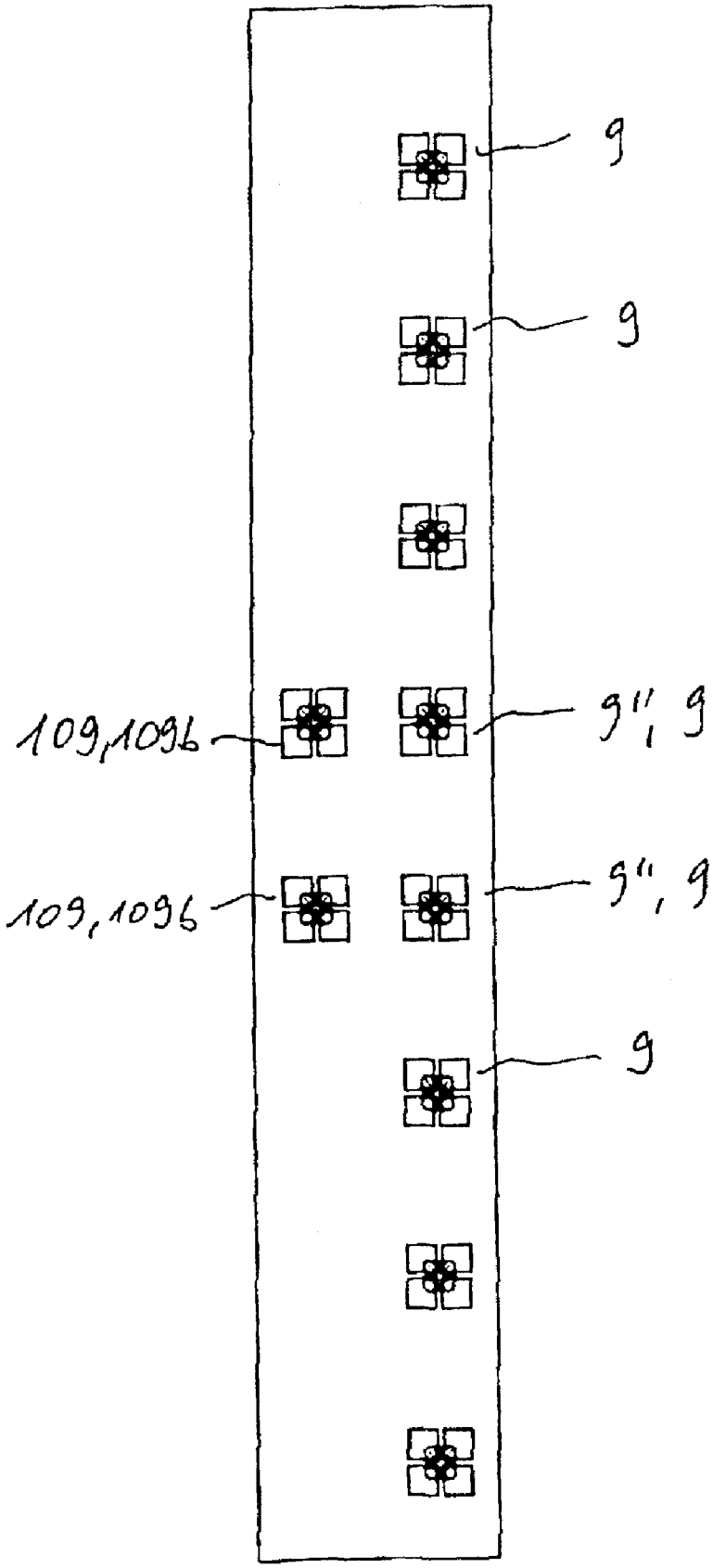
FIG. 3 shows a corresponding excerpt from the antenna array shown in FIG. 1, but with regard to the originally provided radiators or radiator groups in the second column and the further provision according to an exemplary illustrative non-limiting implementation of horizontally offset additional radiators or radiator groups.

Correspondingly, additional radiators or radiator groups, 109, 109*b*, are also provided for the radiators or radiator groups, 9, for the second column, 5*b*, which—as can be seen in FIG. 3 in particular—are also arranged centrally, offset in the direction of the first column 5*a*. These additional radiators or radiator groups, 109, 109*b*, are also fed commonly with the radiators or radiator groups, 9, in the second column 5*b*. Here, the additional radiators, 109*b*, in the column 5*a* are placed on the same height line as the adjacent radiators or radiator groups, 9", in the second column 5*b*.

Figure 2:
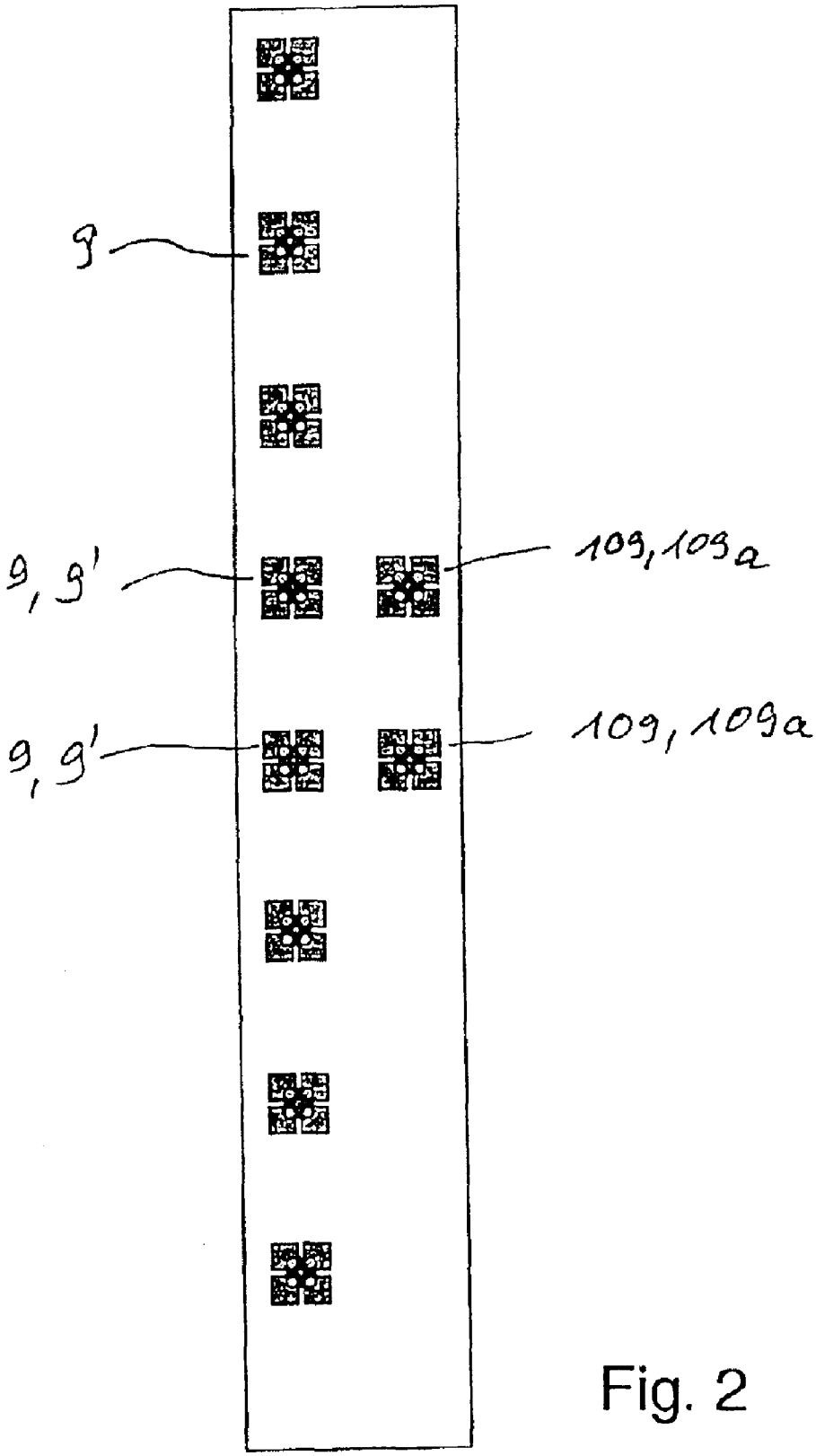
FIG. 2 shows a detailed illustration of the antenna array according to the exemplary illustrative non-limiting implementation depicted in FIG. 1 having radiators or radiator groups in only one column and the horizontally offset additional radiators or radiator groups in an adjacent column, provided according to an exemplary illustrative non-limiting implementation.

The exemplary illustrative non-limiting antenna depicted in FIG. 1 is made up of the two antenna parts shown in FIG. 2 and FIG. 3.

Since according to the exemplary illustrative non-limiting implementations as shown in FIGS. 1 to 3 there is further provision that the radiators or radiator groups in the first column 5*a* are arranged offset by half the vertical spacing of two radiators or radiator groups, 9, arranged in the adjacent column, this opens the possibility that the respective additional radiators or radiator groups, 109, 109*a*, or 109, 109*b* for reducing the respective lobe width in the respective other column to their own, come to lie at the same height and, in fact, between two vertically neighboring radiators or radiator groups provided there.

As has already been explained, the two-column antenna array can be provided without the down-tilt facility. All radiators, 9, are then fed identically via the feeder inputs 11*a* and 11*b* for both polarizations. That is why the radiators 109*a* and 109*b* provided additionally for the respective main groups 5*a* and 5*b*, arranged, as it were, in an adjacent column, can each be fed with the same phase angle as the radiators that belong to the respective main column. However, if an integrated feeder network is used to feed each of the radiators arranged vertically one above with a different phase angle, for example, (or to always feed two groups of radiators arranged one above the other with a different phase angle), i.e. to allow the setting of a down-tilt angle of varying degree, then it is advisable, as far as possible, to feed the additional radiators or radiator groups, 109*a*, 109*b*, which are provided for and assigned to the radiators in the respective main column but placed in an adjacent column, with the same phase angle or the nearest phase angle as that with which the neighboring radiators lying in the respective main column are also fed. Thus, for example, on appropriate lowering of the radiated field pattern with a particular down-tilt angle, the radiator 9' placed in the left column 5*a* should be fed with the same phase angle as the additional radiator 109'*a* arranged in the adjacent column, in the exemplary illustrative non-limiting implementation shown in FIG. 1.

The additional radiator 9" lying below it can, for example, be fed at a further shifted phase angle, but commonly with the radiator arrangement 109"*a* located in the adjacent column. The same applies for the additional radiators 109*b* shown light-colored in FIG. 1, which are fed with the corresponding same phase angle (and, in fact, separately for each polarization as well) as the radiators located to the right of them in column 5*b*.

Figure 1A:
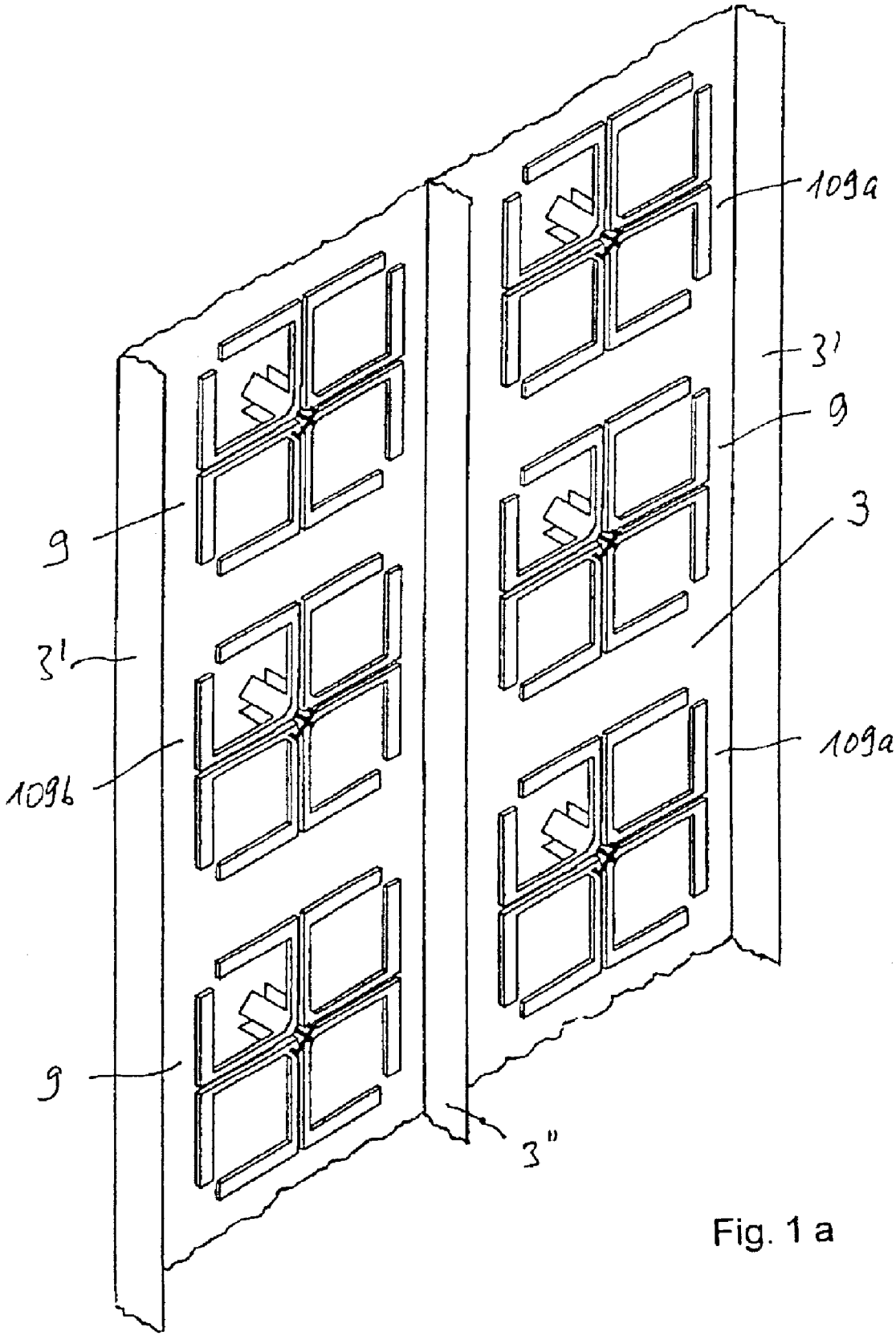
FIG. 1*a* shows an excerpt from a schematic perspective drawing of what is known as a dipole radiator, as it is used in the exemplary illustrative non-limiting implementation according to FIG. 1.

For completeness' sake, you are again referred to FIG. 1*a*, which shows in detail an enlarged excerpt of the antenna shown in FIG. 1. From this it can also be seen that, at the exterior on the vertical edge of the reflector, an edge demarcation 3' can also be provided, which essentially runs vertically or at least transverse to the reflector plane 3. The individual columns 5*a* and 5*b* can also be separated or divided up by a further partition or separating ridge that lies between them, preferably running vertical to the reflector plane, which may be of a different height than the edge demarcations lying at the outer edge 3'.

Figure 4:
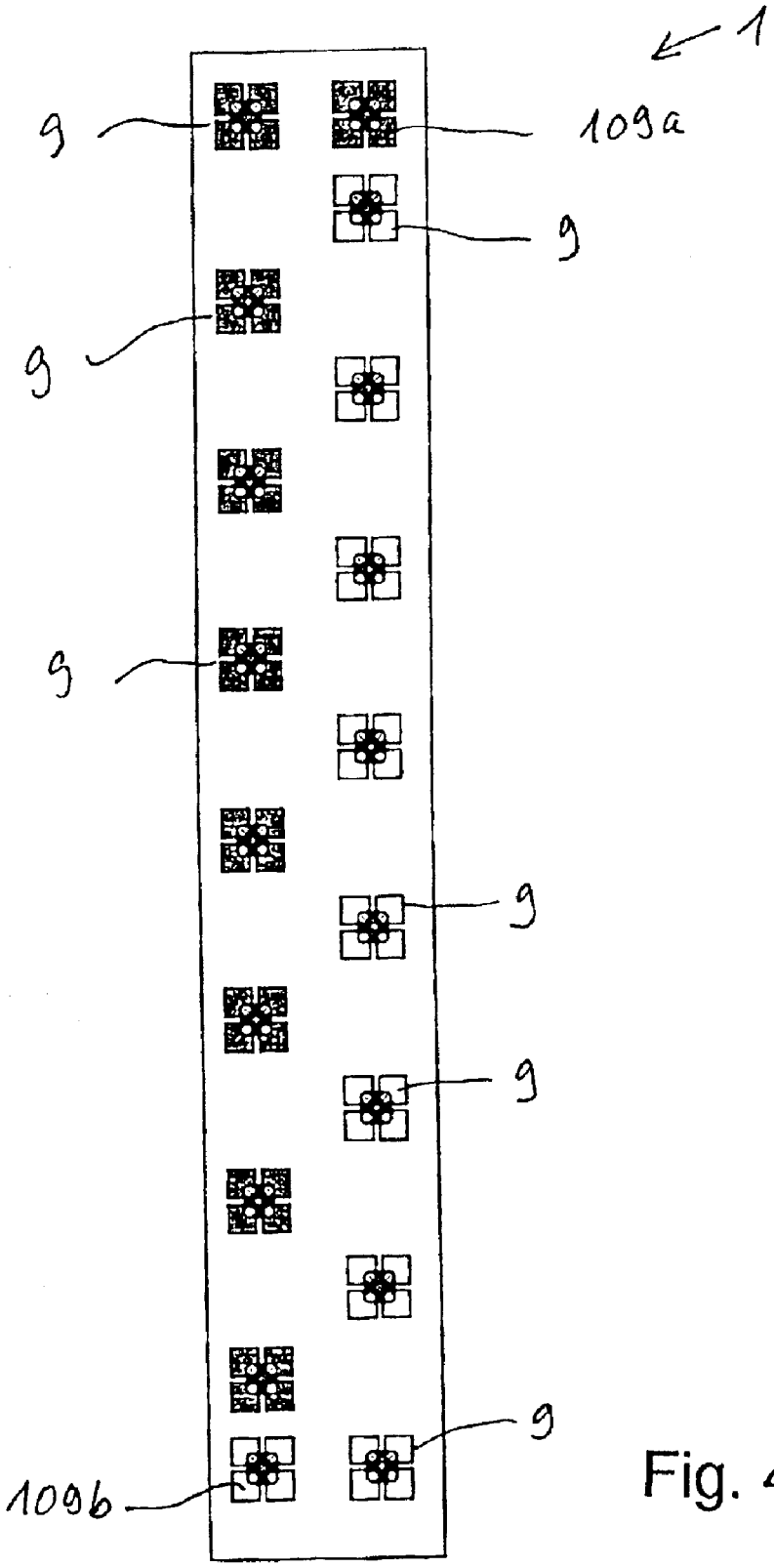
FIG. 4 shows a modified exemplary illustrative non-limiting implementations of the antenna array shown in FIG. 1.

The exemplary illustrative non-limiting implementation shown in FIG. 4 differs from that shown in FIG. 1 in two respects, namely, first in that for each column 5 only one additional radiator or one additional radiator group, 109*a* and 109*b* respectively, is provided, and which second, rather than being placed in the middle region of the antenna array, here instead is laterally offset to the respective uppermost and lowermost arranged radiator element. By this means, too, the lobe width with respect to all radiators or radiator arrangements in a particular column is reduced.

Figure 5:
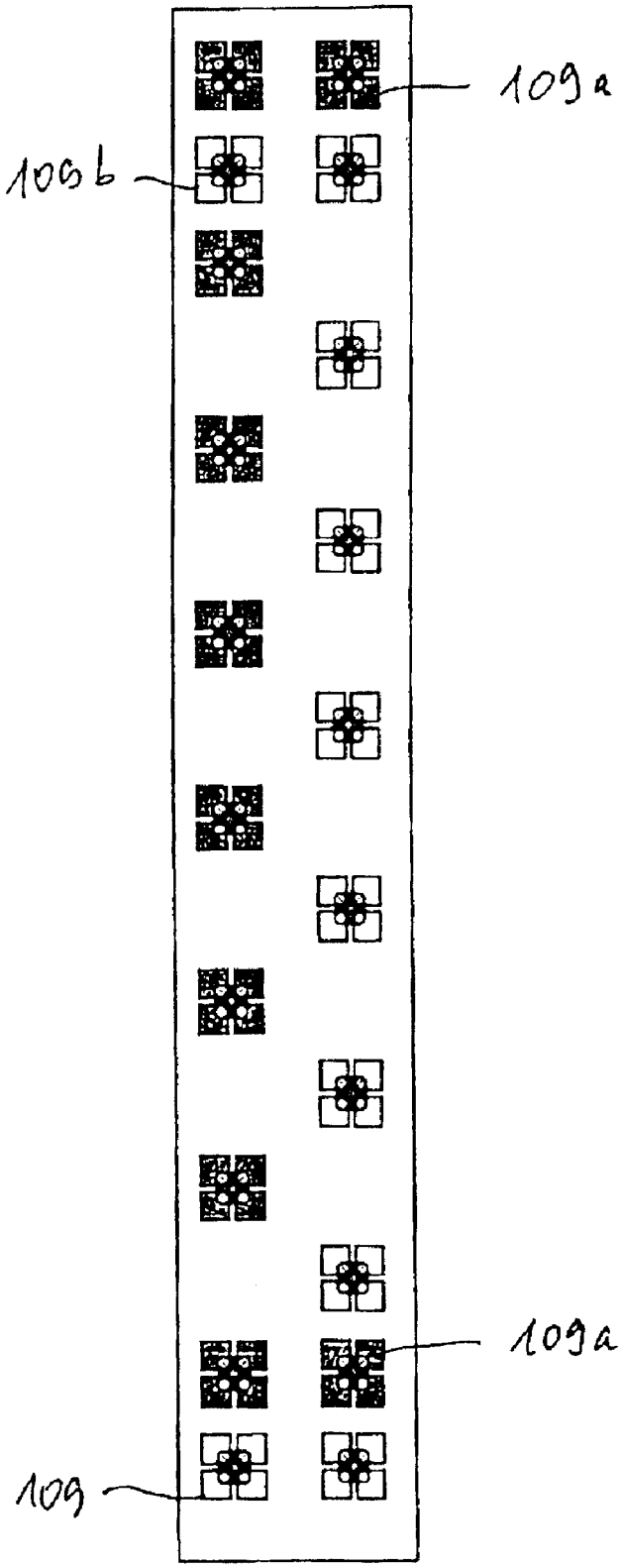
FIG. 5 shows a further modified exemplary illustrative non-limiting implementation.

In the exemplary illustrative non-limiting implementation shown in FIG. 5 there are, in turn, two additional radiators or radiator arrangements, 109*a* and 109*b* respectively, provided per column, these being at the upper and lower end or end region of the antenna array.

Figure 6:
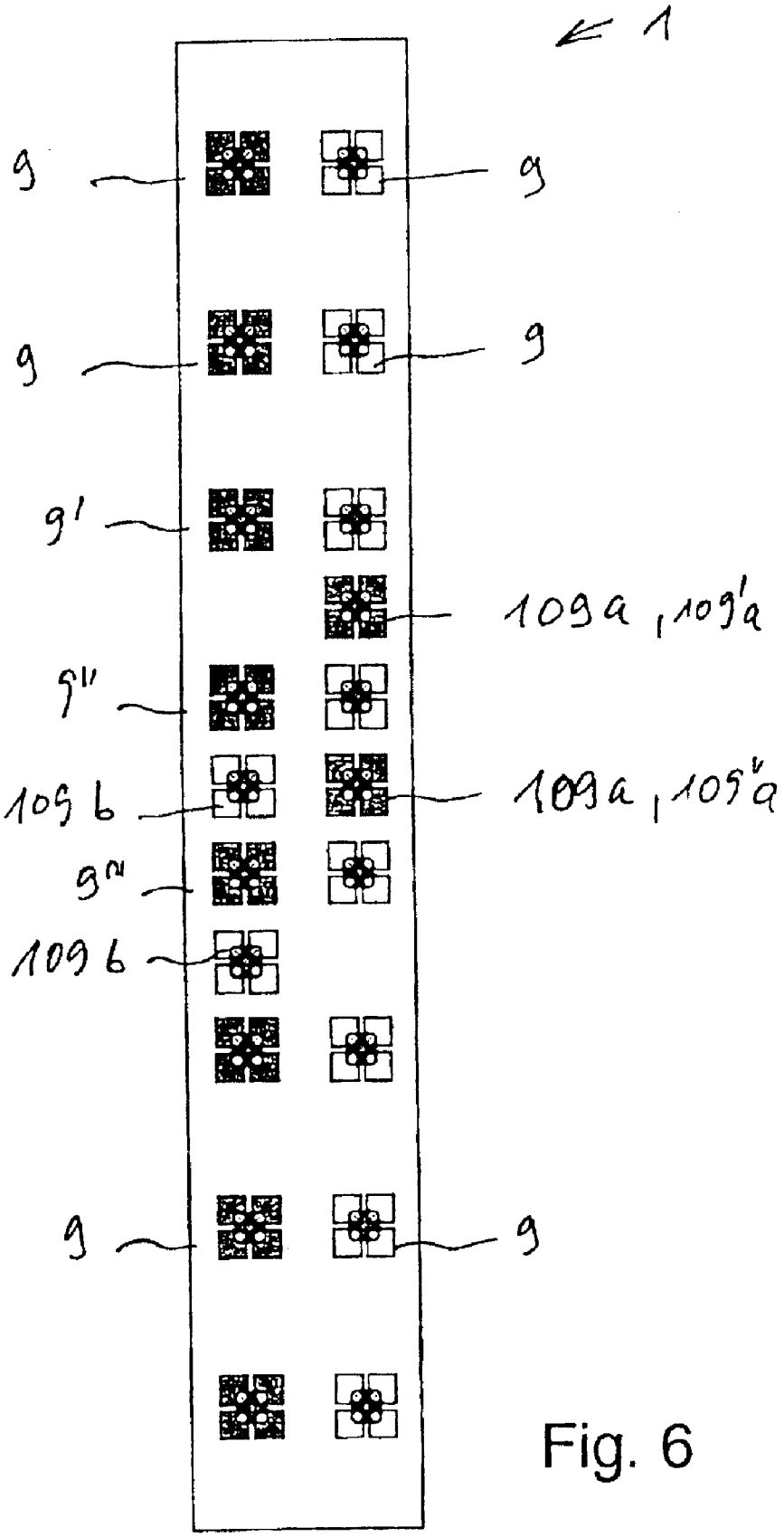
FIG. 6 shows a further modified exemplary illustrative non-limiting implementation.

In the exemplary illustrative non-limiting arrangement shown in FIG. 6, the originally provided radiators or radiator groups, 9, in each column 5 are arranged at the same horizontal height level to one another, i.e. in pairs. In this case, the additionally provided radiators or radiator groups, 109, which are mounted alternately in the adjacent column, must be provided at an intermediate level to those radiators or radiator groups in the respective main column, as can be seen in FIG. 6.

In this case, and especially where a feeder network is then provided for the adjustment of a varying down-tilt angle, the additional radiators 109*a* and 109*b* provided for a respective main column 5*a* or 5*b* and placed in the respective adjacent column to this, 5*b* or 5*a*, can be fed with a phase angle that corresponds either to the optimum phase angle according to their horizontal arrangement, or else with a phase angle that matches, for example, that of the radiator placed immediately above or immediately below in the associated main column 5*a* or 5*b*. For example, in the exemplary illustrative non-limiting arrangement shown in FIG. 6, the upper additional radiator 109'*a* could therefore exhibit a phase angle which corresponds to that of either radiator 9' or radiator 9" in the associated main column 5*a*. The additional radiator 109"*a* provided in column 5*b* could in turn exhibit a phase which corresponds to the phase angle of radiator 9" or 9'" provided in the main column 5*a*. The same also applies of course for the additional radiators 109*b* provided in column 5*a*, which are driven commonly with the corresponding radiators arranged in the associated main group 5*b*.

Figure 7:
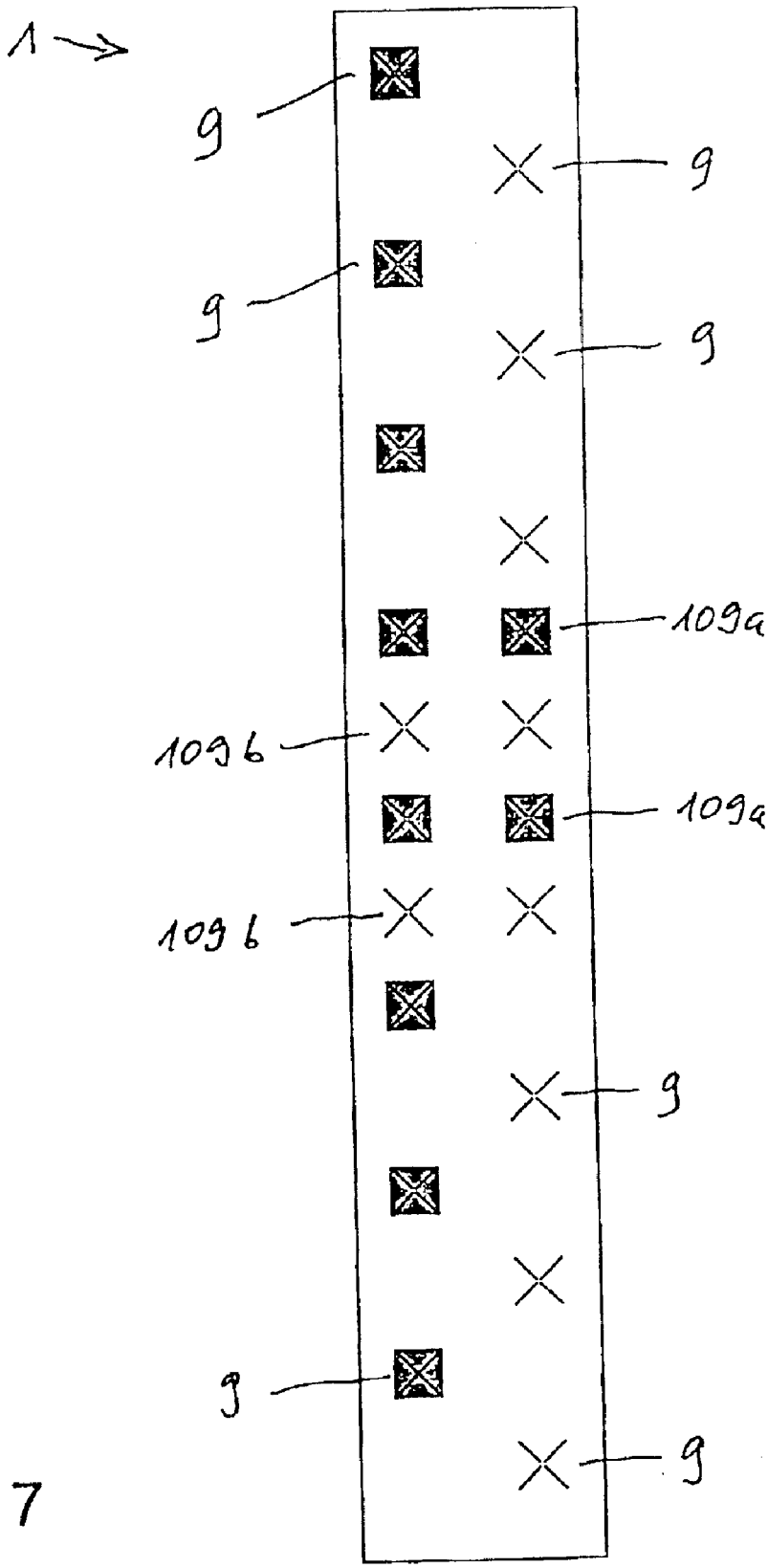
FIG. 7 shows a further modified exemplary illustrative non-limiting arrangement of FIG. 1 comprising a multiplicity of X-shaped dipole radiator groups (X radiators)

FIG. 7 shows that an identical antenna arrangement to that in FIG. 1 can be built, for example, using conventional X radiators.

Figure 8:
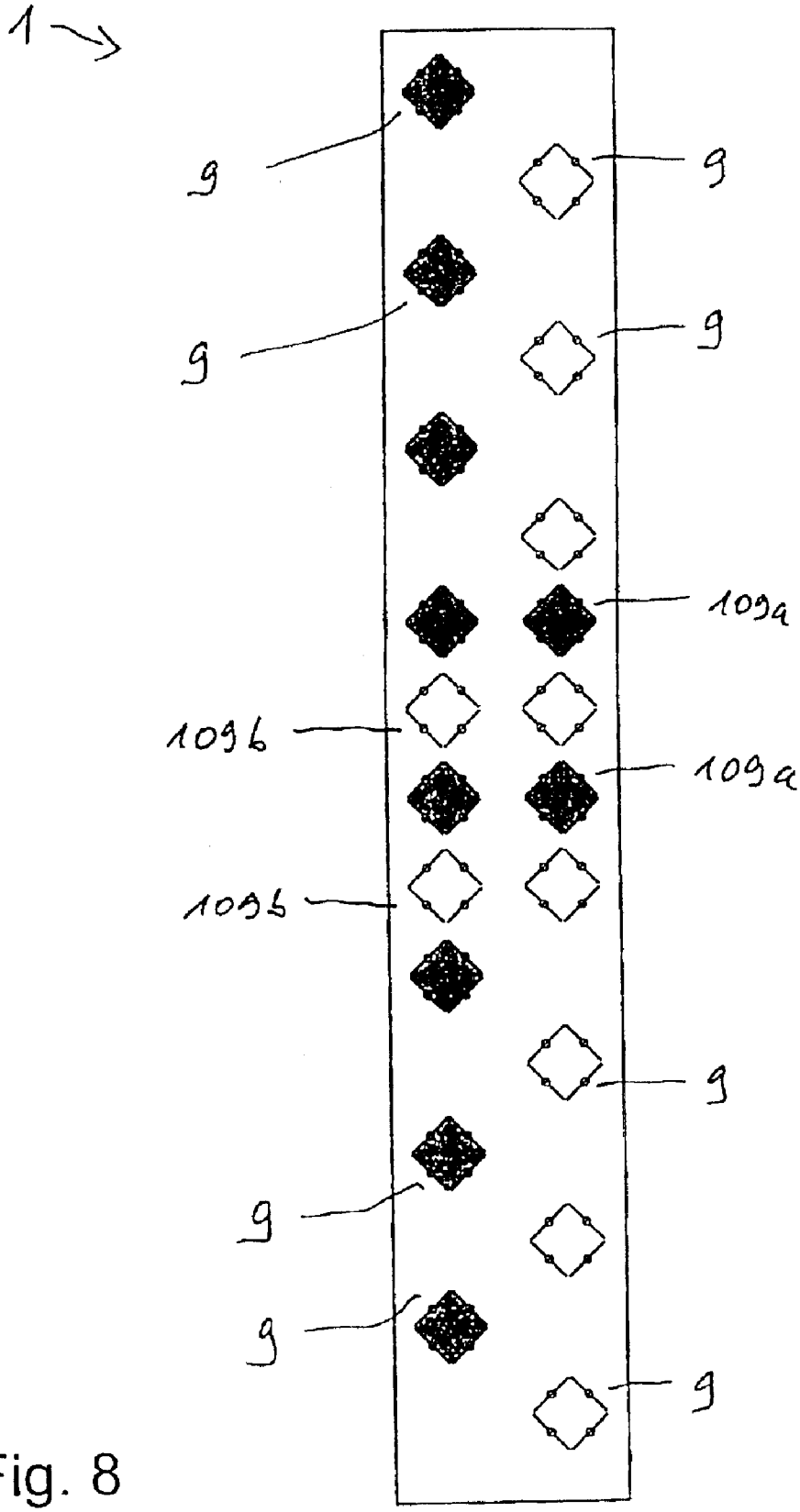
FIG. 8 shows a further exemplary non-limiting arrangement using dipole quads composed of dipoles for the individual radiator groups.

FIG. 8 shows that instead of the X radiators, dipole quads, for example, can also be used.

Figure 9:
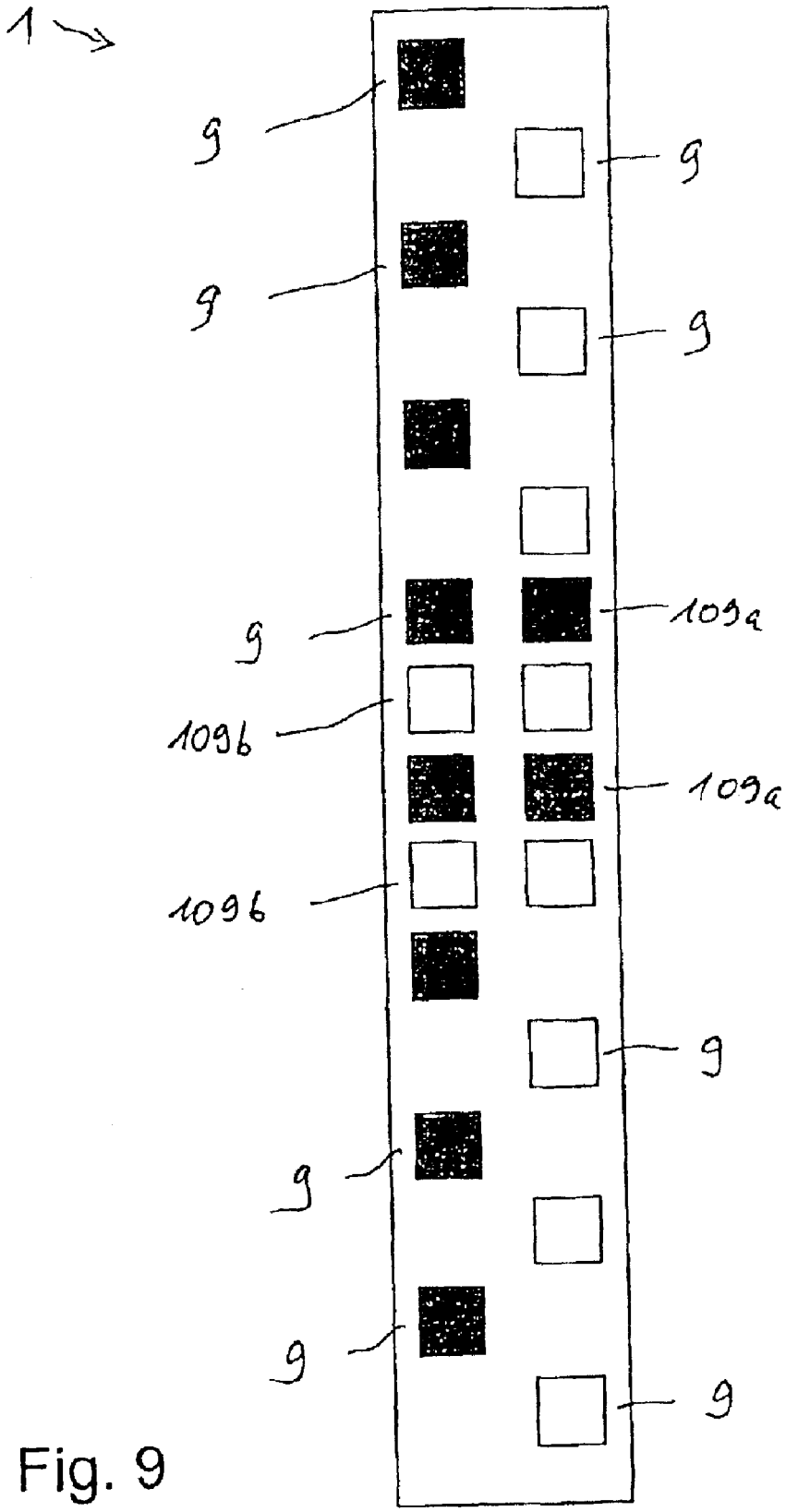
FIG. 9 shows a further modified exemplary non-limiting arrangement of FIG. 1 for a two-column antenna array using patch radiators.

FIG. 9 shows a corresponding illustrative non-limiting arrangement that makes use of patch radiators.

With appropriate orientation, all of the aforementioned antenna arrays are built such that they radiate or receive in two polarization planes perpendicular to one another, which are oriented by +45° or −45° with respect to the horizontal or vertical.

Figure 10:
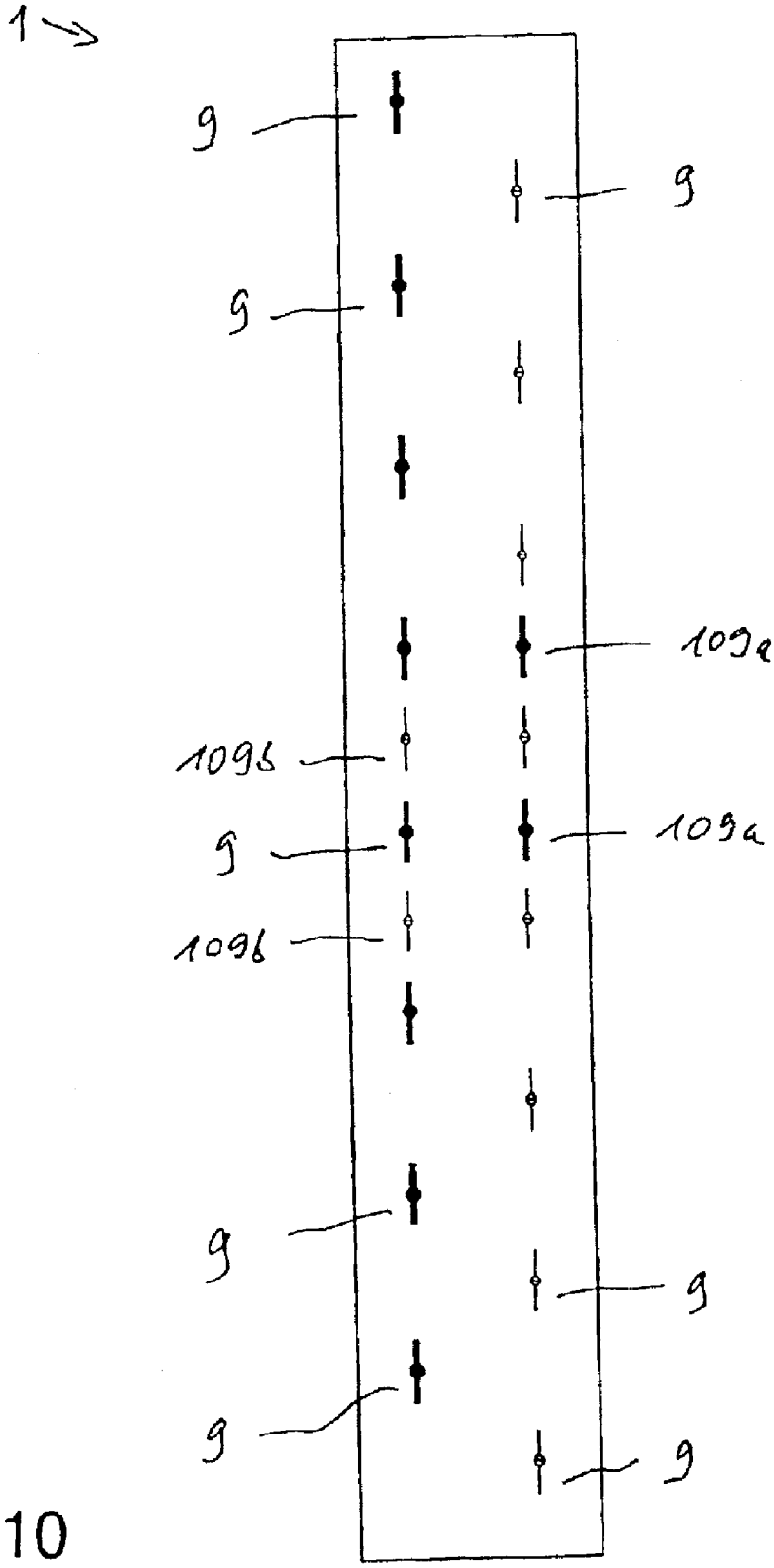
FIG. 10 shows a further modified exemplary non-limiting arrangement using singly polarized radiators, preferably linear polarized dipole radiators, which according to this exemplary embodiment are oriented in a vertical direction.

In the exemplary illustrative non-limiting arrangement shown in FIG. 10, an antenna array is shown with two columns 5 having solely vertically polarized dipoles. This example shows that it is not mandatory for radiators or radiator groups to consist of dual-polarized radiators (or of circularly polarized radiators, for example), but that they may equally be linearly polarized radiators or radiator groups.

The same technical measures are employed in all examples to reduce the lobe widths of the radiated field pattern for the individual columns 5.

Figure 11:
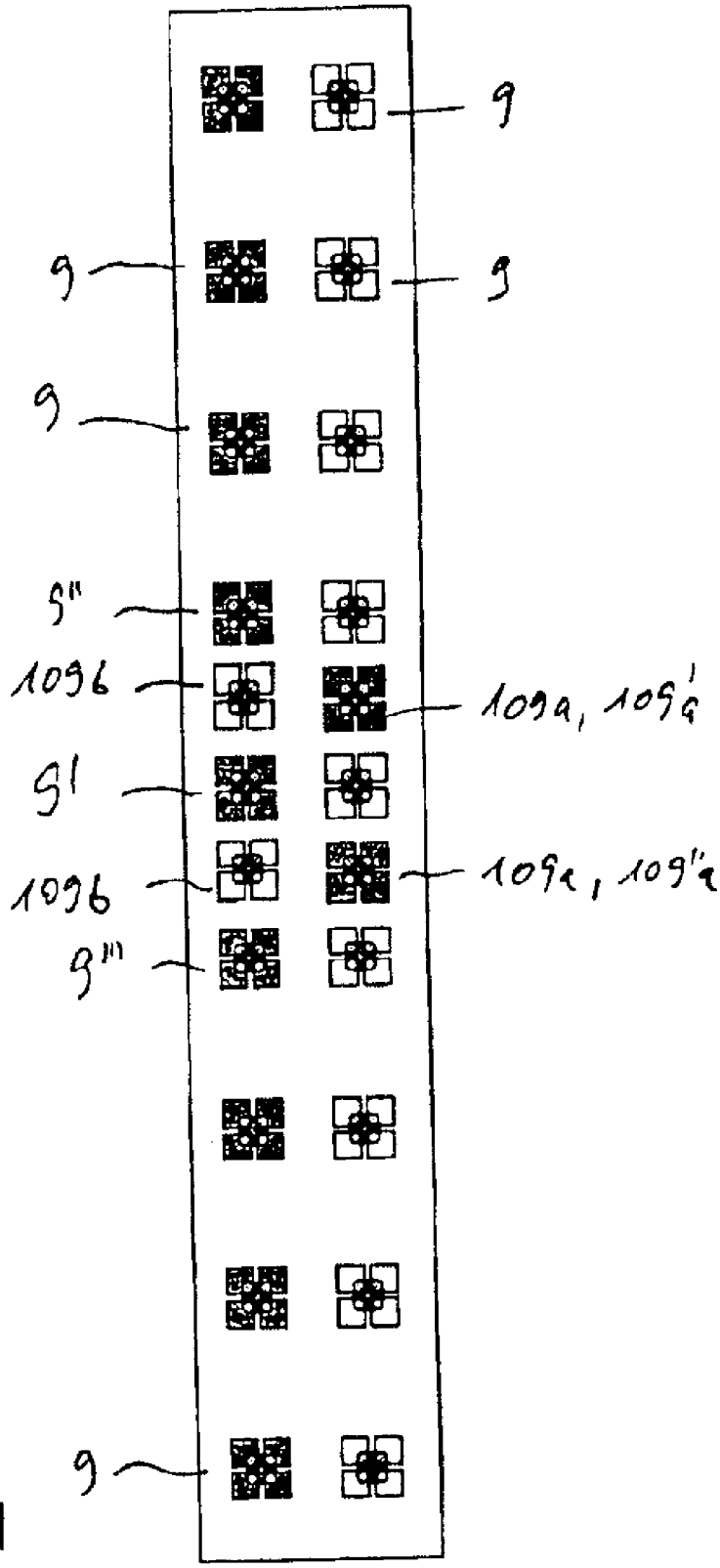
FIG. 11 shows a further modified exemplary illustrative non-limiting arrangement.

FIG. 11 specifies a further variant. The two-column antenna array 1 shown in FIG. 11 is essentially of similar construction to the exemplary illustrative non-limiting implementations shown in FIGS. 1 to 3. The particular differences lie firstly in that basically only an odd number of main radiators, 9, are placed in each column, namely in column 5*a* in the same vertical section one above the other, nine radiators, 9, in this exemplary illustrative non-limiting implementation, just the same as in column 5*b*. As a result of the odd number of main radiators in each column, one radiator, 9', ends up in the middle of the antenna array in each case.

In this exemplary illustrative non-limiting implementation two additional radiators 109*a*, namely 109'*a* and 109"*a* are provided for the radiators provided in column 5*a*, which are now placed at one half vertical spacing, according to the vertical spacing grid size, between the radiators, 9. If the antenna is again operated at a certain down-tilt angle, whereby the radiators, 9, arranged in a column vertically one above the other are fed with a different phase angle, in this exemplary implementation the additionally provided radiators 109'*a* and 109"*a* are preferably fed with the same phase angle as the radiator, 9', provided in the associated main column, i.e. placed centrally here in column 5*a*. The same applies for the light-colored radiators shown in FIG. 11. There, the middle radiator in column 5*b* is fed with the same phase angle as the two additional radiators 109*b* that lie offset to it, provided in column 5*a*. It is-of course equally conceivable that, for example, the additional radiator 109'*a* is fed with the phase angle of radiator 9". Further additional radiators 109"*a* could be fed with the phase angle of the lower lying radiator 9'". By this means, too, greater symmetry has been achieved.

In addition it should be noted that the radiators or radiator groups, 9, in a column 5 having a spacing from the respective radiators or radiator groups, 9, in the adjacent column 5*b* of e.g. between 0.25 A and 1 A, preferably around A/2. Here, A represents a wavelength of the operating wavelength, preferably the mean operating wavelength in a frequency band to be transmitted. The vertical spacing of the individual radiators in the separate columns differs preferably in the range 0.7 A to 1.3 A.

In deviation from the exemplary illustrative non-limiting implementations shown, antenna arrays with three, four or even more columns can also be envisaged, whereby the columns preferably have uniform spacing from one another when viewed in a horizontal direction. However, columns with irregular spacings from one another are also possible.

By means of the exemplary illustrative non-limiting implementations, it has been shown that the number of extra radiators which additionally are integrated into the respective other column consist of at least one radiator or at least one radiator group 109, 109*a* or 109*b*. Preferably, the number of these additionally provided radiators 109*a*, 109*b* is limited as regards the maximum to a number that is one less than the "radiators or radiator groups provided" in the associated main column.

The respective additionally provided radiators or radiator groups, 109, 109' do not have to be provided exactly in the vertical line in which the radiators or radiator groups of the respective adjacent column are placed. In other words an additional offset in the horizontal direction can be provided here.

By means of the additional radiators or radiator groups according to the exemplary illustrative non-limiting implementations, just explained, it is possible to achieve lobe widths of, for example, preferably 45°, 50°, 55°, 60° or also 65° or 70° or any intermediate values. Here it is also possible not to provide one or more columns with the elucidated additional integrated radiators, with the effect that conventional lobe widths for these columns of, for example, 75°, 80° or 85° are attainable.

By means of the elucidated exemplary illustrative non-limiting implementations, it follows that the individual columns 5, 5*a*, 5*b* etc. are electrically adjustable independent of one another, preferably via separate phase shifters. In just the same way, however, the columns can also be commonly adjusted electrically, preferably via coupled phase shifters. If the elucidated examples of antenna arrays are provided with an integrated electromechanical unit, it is possible to undertake electrical lowering of the main radiator (main lobe) of the respective radiators arranged in a column by means of remote control. Retrofitting can also be carried out here, if necessary, to implement lowering via remote control.

Finally, the columns can also be driven commonly, with a Butler matrix, for example, or other series connected beam-shaping networks in order to achieve what is known as beam-shaping.

The columns can also be connected with hybrids, however, in order to implement beam-shaping.

The antennas can also be fitted with a calibration device to determine the phase angle of the individual columns.

In all of the exemplary non-limiting illustrative implementations shown, it is assumed that the additionally provided radiators are always fed commonly with the actual radiators provided in an adjacent column and with the same phase angle. In principle, it would also be possible, however, to feed the radiators or radiator groups additionally provided for a column and placed laterally offset to it, with an electrical phase that differs from the assigned column, whereby the "tracking procedure" can be further modified.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

What is claimed is:

1. A two-dimensional antenna array comprising:

at least two vertically oriented columns, at least one of said columns comprising at least two radiators or radiator groups arranged in a vertical direction and vertically offset with respect to each other;

at least one additional radiator or radiator group provided for said at least one column, said at least one additional radiator or radiator group being fed commonly with the radiators or radiator groups provided in said at least one column, the additionally provided at least one radiator or radiator group for said at least one column being arranged horizontally offset to the other radiators or radiator groups provided in said at least one column.

2. The antenna array as claimed in claim 1, wherein the at least one additionally provided radiator or radiator group is accommodated in an adjacent column.

3. The antenna array as claimed in claim 1, wherein the at least one additionally provided radiator or radiator group is arranged in a respective adjacent column between two neighboring radiators or radiator groups in a vertical direction.

4. The antenna array as claimed in claim 1, wherein the at least one additionally provided radiator or radiator group is placed on the vertical connecting line between the otherwise provided radiators or radiator groups in said column.

5. The antenna array as claimed in claim 1, wherein the at least one additionally provided radiator or radiator group lies offset to the vertical connecting line between the otherwise provided radiators or radiator groups in said column.

6. The antenna array as claimed in claim 1, wherein the radiators or radiator groups in a column lie vertically offset to those of an adjacent column by half the vertical spacing between two radiators or radiator groups placed vertically one above the other.

7. The antenna array as claimed in claim 1, wherein the radiator or radiator groups in a column lie at the same horizontal elevation as those in an adjacent column.

8. The antenna array as claimed in claim 1, wherein at least five radiators or radiator groups are arranged one above the other in the columns with vertical offset, and that the at least one additionally provided radiator or radiator groups are placed centrally or mostly centrally with respect to the entire vertical length of the antenna array.

9. The antenna array as claimed in claim 1, wherein at least five radiators or radiator groups are arranged one above the other in the columns with vertical offset, and that the at least one additionally provided radiator or radiator groups are placed at the upper or at the lower end of the antenna array.

10. The antenna array as claimed in claim 1, wherein the columns exhibit a spacing of 0.25 A to 1 A, where A is operating wavelength.

11. The antenna array as claimed in claim 1, wherein the vertical spacing of the radiators or radiator groups in said column, without taking into account additional radiators or radiator groups, lies between 0.7 A and 1.2 A, where A is mean operating wavelength.

12. The antenna array as claimed in claim 1, wherein the radiators or radiator groups are selected from the group comprising dipoles, cross dipoles, X-shaped radiating vector dipoles, linearly polarized radiators and patch radiators.

13. The antenna array as claimed in claim 1, wherein the radiators or radiator groups provided in a column and additional radiators or radiator groups in an associated column assigned to these radiators are fed with the same electrical phase.

14. The antenna array as claimed in claim 1, wherein the radiators or radiator groups provided in a column and additional radiators or radiator groups in an associated column assigned to these radiators are fed with varying electrical phase to alter the tracking behavior.

15. The antenna array as claimed in claim 1, wherein the individual columns can be adjusted electrically independently of one another, using phase shifters.

16. The antenna array as claimed in claim 1, wherein the individual columns can be commonly adjusted electrically, using coupled phase shifters.

17. The antenna array as claimed in claim 1, wherein in the adjustment of a down-tilt angle by the use of a varying phase-position feed for the various radiators arranged vertically one above the other, the additionally provided radiators are fed with a phase angle, which corresponds to that of the radiator provided in a column, which lies at the same height level, or lies at a vertical offset not greater than the spacing between two associated radiators arranged vertically one above the other in said column.

18. The antenna array as claimed in claim 1, wherein two additional radiators are fed with the same phase angle as a radiator in the associated column.

19. The antenna as claimed in claim 1, wherein in each column an odd number of radiators are provided, arranged vertically one above the other.

20. The antenna array as claimed in claim 19, wherein at least one radiator is provided in each column is fed commonly with two additional radiators provided in an adjacent column, with the same phase angle.

21. A two-dimensional antenna array comprising:

at least two columns running vertically, at least one column having at least two radiators or radiator groups arranged in a vertical direction with respect to each other;

the at least one column having at least two radiators or radiator groups vertically offset from one another;

at least one additional radiator group which is fed commonly with the radiators or radiator groups in said at least one column, the at least one additional radiator group for said at least one column arranged horizontally offset to the other radiators or radiator groups in the column.

22. A two-dimensional antenna array having plural vertically-oriented radiator columns, said array including at least one radiator column comprising:

a first set of vertically offset radiators; and a further set of radiators horizontally offset from said first radiator set;

wherein said first and further radiator sets are fed in common.

* * * * *